United States Patent [19]

Rauch

[11] Patent Number: 4,776,054

[45] Date of Patent: Oct. 11, 1988

[54] TOOTHBRUSH

[76] Inventor: Samuel Rauch, 40 Spruce St., Cedarhurst, N.Y. 11516

[21] Appl. No.: 21,713

[22] Filed: Mar. 4, 1987

[51] Int. Cl.[4] ..... A46B 9/04

[52] U.S. Cl. ..... 15/167.1; 15/110; D4/104

[58] Field of Search ..... 15/167.1, 167.2, 110; D4/104; 128/62 A

[56] References Cited

U.S. PATENT DOCUMENTS

| | | | |
|---|---|---|---|
| D. 175,894 | 10/1955 | Krueger . | |
| D. 179,441 | 12/1956 | Clemens . | |
| D. 187,976 | 5/1960 | Farber . | |
| 2,047,613 | 7/1936 | Brown . | |
| 2,567,080 | 9/1951 | Pifer | 15/167.1 |
| 2,685,703 | 8/1954 | Dellenbach . | |
| 2,845,649 | 8/1958 | Hutson . | |
| 3,085,273 | 4/1963 | Cowan | 15/167.1 |
| 3,722,020 | 3/1973 | Hills . | |
| 4,010,509 | 3/1977 | Huish . | |
| 4,081,876 | 4/1978 | Pugh | 15/167.1 |
| 4,137,593 | 2/1979 | Porper . | |
| 4,288,883 | 9/1981 | Dolinsky . | |

FOREIGN PATENT DOCUMENTS

| | | |
|---|---|---|
| 452708 | 5/1913 | France . |
| 683311 | 6/1930 | France . |
| 1247433 | 10/1960 | France . |

*Primary Examiner*—Peter Feldman
*Attorney, Agent, or Firm*—Daniel Jay Tick

[57] ABSTRACT

A toothbrush for efficient cleaning of the teeth, the area under the sulcus and between the teeth and for massage and stimulation of the gums, has a plurality of spaced longitudinally extending rows of bristles in center and outer rows extending from the brushhead. The bristles of the center rows extend perpendicularly to the brushhead and the bristles of each of the outer rows are inclined in different directions relative to the bristles of the center rows. The bristles of each of the outer rows are inclined in one direction from approximately the center of the row to one end thereof and in the opposite direction from approximately the center of the row to the opposite end thereof. Each of the one and opposite directions is away from a normal line at approximately the center of the row. The bristles of the outer rows may also be inclined away from the planes of the bristles of the center rows.

16 Claims, 4 Drawing Sheets

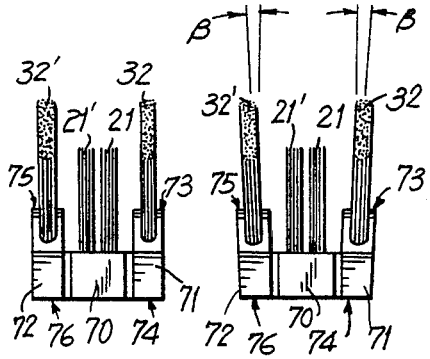
FIG. 3B
FIG. 3A
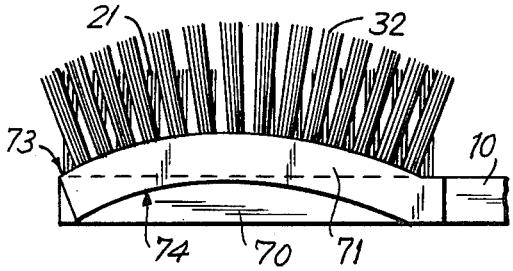
FIG. 3
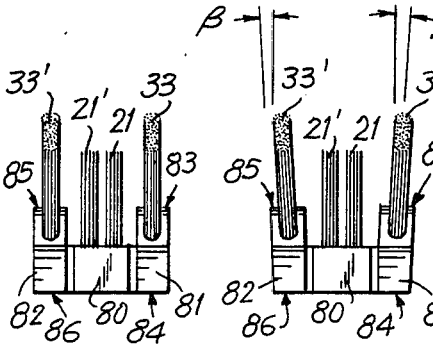
FIG. 4B
FIG. 4A
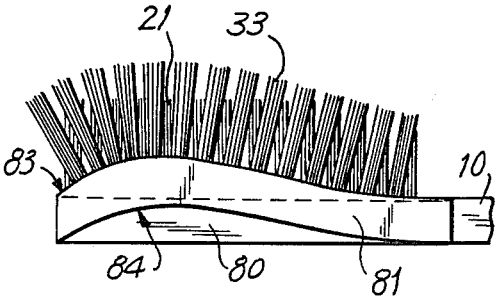
FIG. 4
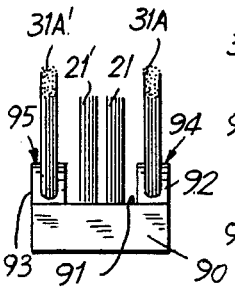
FIG. 5B
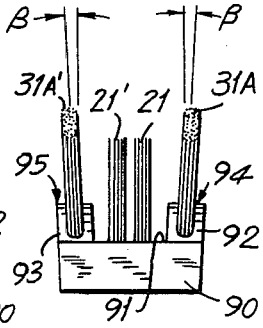
FIG. 5A
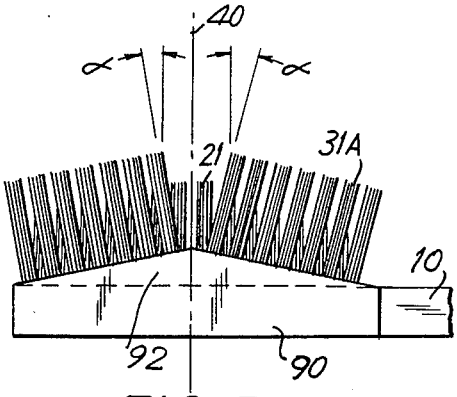
FIG. 5

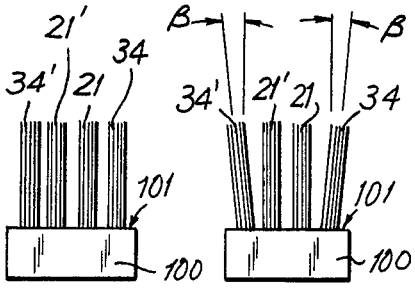
FIG. 6B
FIG. 6A
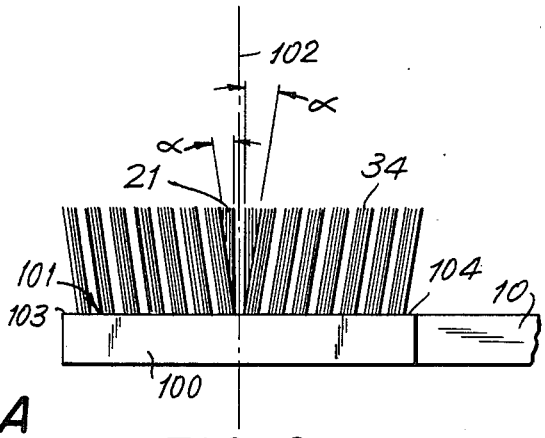
FIG. 6
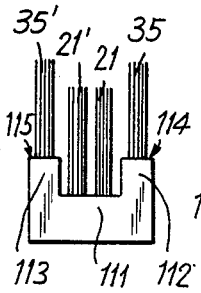
FIG. 7B
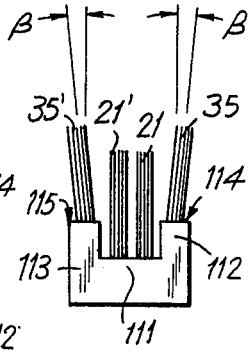
FIG. 7A
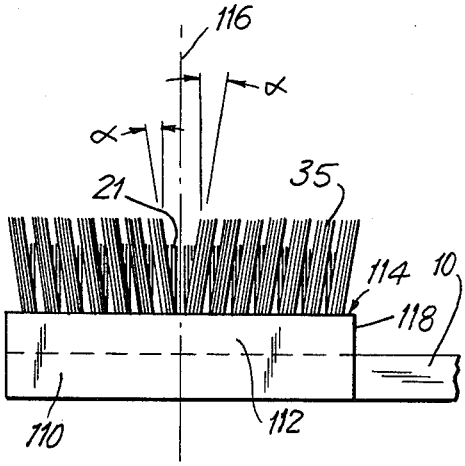
FIG. 7

TOOTHBRUSH

BACKGROUND OF THE INVENTION

The present invention relates to a new and improved toothbrush. More specifically, the invention relates to a toothbrush having bristles in the outermost rows inlined in different directions relative to upright bristles in the central rows and projecting beyond the central bristles so that when the toothbrush is used in a natural or professional prescribed manner, increased crubbing and bristle flexing and probing at the toothbristle interface results in more effective and efficient removal of plaque from the inter-dental areas and also from the gingival margins and from under the sulcus.

Although bacterial plaque has been recognized as the prime cause of tooth decay and periodontal disease which results in tooth loss, fluorides put in drinking water, toothpastes and mouthwashes have made tooth enamel resistant to said bacterial plaque with a very significant reduction of tooth decay. Tooth loss today in most advanced countries, is caused by unremoved plaque in the inter-dental areas and gum margins hardening into tartar. This results in subsequent gum irritation, recession and bacterial infection of the gums, exposure of the decay prone dentine, invasion of bacteria and degeneration of bone resulting in loosening of the teeth.

In order to make a significant contribution in reducing tooth loss, a modern, improved toothbrush must address these issues. It must remove plaque in and around inter-dental areas, gum margins and under the sulcus. It must gently massage the gums at the interface of the tooth and gum, thus contributing to the general health of the gums in essentially the same way that exercise contributes to the general health of living tissue by drawing blood into the exercised area.

The importance of caring for gums and teeth as a system for proper oral health care was firth taught by U.S. Pat. No. 2,845,649 wherein soft toothbrush bristles and massages were recommended as best for gingival tissue.

Pugh, in U.S. Pat. No. 4,081,876, expanded and used the soft bristle concept and taught the value of inclined bristles or filaments flexing relative to the upright as brushing force is applied to the toothbrush handle, so that plaque is removed more effectively by the flexing action.

Many toothbrushing techniques have been developed by dental professionals. The most popular current technique is the Bass, or Stillman technique. A current textbook describing this technique is "Glickman's Clinical Periodontology," Ferman A. Carranza, Jr., Dr. ODONT, 5th edition, 1979, pages 729–738 published by W. B. Saunders Co., Philadelphia. The Bass Stillman Toothbrushing Technique calls for short horizontal brush strokes and angling the bristles 45° into the gumline. This technique and others taught by dental health professionals, if applied faithfully by the average person using any of many conventional toothbrushes commercially available will result in reasonably clean, plaque-free teeth in the critical areas previously described.

Recent surveys have shown that the average person does not use a professionally developed and recognized toothbrushing technique or take the time necessary to brush his or her teeth properly. The average person brushes their teeth in a casual manner using brushstrokes that are basically, but not entirely, horizontal while brushing for a short period of time compared to what is required for the Dr. Bass or a similar professional toothbrushing technique. Conventional toothbrushes used in this casual manner do not provide proper oral health care.

In order to be effective, a modern, improved toothbrush must function in an optimum manner in the interdental, gingival margin and sulcus area, if used with a professionally developed toothbrushing technique, or if used in the usual casual manner.

The principal object of the invention is to provide a toothbrush which greatly reduces and prevents tooth decay, tooth loss and gum diseases.

An object of the invention is to provide a toothbrush which is usable with facility and ease and which, when used properly, will greatly reduce and prevent tooth decay, tooth loss and gum diseases.

Another object of the invention is to provide a toothbrush of simple structure, which greatly reduces and removes bacterial plaque, when used in a simple prescribed manner, thereby greatly reducing and eliminating tooth decay and gum diseases.

Still another object of the invention is to provide a toothbrush which may be used in a casual manner to clean the teeth and massage the gums in a superior manner.

Yet another object of the invention is to provide a toothbrush which may be used in a casual manner to clean and massage the inter-dental, gum margin and sulcus areas in a superior manner.

Another object of the invention is to provide a toothbrush having inclined bristles, which flex relative to the upright when the brush is properly used and provide effective flexing action to clean and massage the interdental, gum margin and sulcus areas in a superior manner.

Still another object of the invention is to provide a toothbrush which functions with the highest efficiency, effectiveness and reliability possible in removing plaque in relation to the time and effort expended by the user in brushing the teeth.

Yet another object of the invention is to provide a toothbrush having inclined bristles in both the longitudinal and axial direction which flex relative to the upright to probe, clean and massage critical areas with each brush stroke, regardless of whether the user is pushing or pulling the brushhead via the brush handle. The brush stroke is basically horizontal, but with a small vertical component.

Another object of the invention is to provide a toothbrush having bristles in an outer row or rows that extent beyond others in central sections and are inclined axially relative to the central bristles, thus predispositioning the flexing outer row bristles to splay outward to clean the intertooth areas and under the sulcus areas in a highly effective manner.

Still another object of the invention is to provide a toothbrush having a brushhead with a deep groove between an extended row of bristles at the edge and the central bristles, which groove functions as a superior holding receptacle for toothpaste which is increasingly being used as a carrier for oral health-improving ingredients such as fluorides and tartar dissolving compounds.

Yet another object of the invention is to provide a toothbrush having a brushhead with a longitudinally extending groove formed therein between rows of bristles, which groove holds toothpaste securely, so it will be forced down into the bristles rather than slip off the ends of the bristles as happens on an essentially flat brushing surface, thereby applying a higher concentration of therapeutic and active ingredients to all intended areas.

In accordance with the invention, a toothbrush for efficient cleaning of the teeth, the area under the sulcus and between teeth and for massage and stimulation of the gums, has a substantially longitudinally aligned handle and brushhead at one end of the handle. The toothbrush comprises a pluraity of spaced substantially longitudinally extending rows of bristles in substantially center and outer rows extending from the substantially perpendicularly to the brushhead. The bristles of each of the outer rows are inclined in different directions relative to the bristles of the center rows.

The bristles of each of the outer rows are inclined in one direction from approximately the center of the row to one end thereof and in the opposite direction from approximately the center of the row to the opposite end thereof. Each of the one and opposite directions is away from a normal line at approximately the center of the row.

The rows of bristles are in substantially parallel planes.

The center rows of bristles are in planes substantially perpendicular to the brushhead and the outer rows of bristles are in planes inclined in opposite directions from the planes of the center rows.

The great majority of the bristles of the outer rows extend a greater distance from the brushhead than the bristles of the center rows.

The bristles of the outer rows extend the same distance from the brushhead as the bristles of the center rows in a preferred embodiment.

The brushhead has spaced opposite top and bottom surfaces, a pair of spaced opposite end edges and a pair of spaced substantially parallel slits through the brushhead from the top to bottom surfaces and spaced from one of the end edges. The slits form a center area between them for the center rows of bristles and outer areas on the opposite sides of the slits from the center area for the outer rows of bristles.

The angle of inclination in one direction is substantially 10° to 20° from the normal line in the one direction and the angle of inclination in the opposite direction is substantially 10° to 20° from the normal line in the opposite direction.

The planes of the outer rows are inclined at angles of approximately 5° to 10° with the planes of the center rows.

The free ends of the bristles of each of the outer rows form a substantially flat inverted V configuration relative to the brushhead.

The free ends of the bristles of each of the outer rows form a substantially arcuate configuration relative to the brushhead.

The free ends of the bristles of each of the outer rows form an irregular geometric configuration relative to the brushhead.

The free ends of the bristles of each of the outer rows form a substantially linear and parallel configuration relative to the brushhead and the central axis of the brushhead.

The maximum length of the bristles of the outer rows from the brushhead is approximately 33% greater than the length of the bristles of the center rows from the brushhead.

The center area is substantially planar and each of the outer areas is of substantially flat inverted V configuration. The bristles of each of the outer rows are of substantially equal length and extend from the top surfaces of the outer areas.

The center area is substantially planar and each of the outer areas is of substantially arcuate configuration. The bristles of each of the outer rows are of substantially equal length and extend from the top surfaces of the outer areas.

The center area is substantially planar and each of the outer areas is of the same irregular geometric configuration. The bristles of each of the outer rows are of substantially equal length and extend from the top surfaces of the outer areas.

BRIEF DESCRIPTION OF THE DRAWINGS

In order that the invention may be readily carried into effect, it will now be described with reference to the accompanying drawings, wherein:

FIG. 3 is a side view, on a reduced scale, of a second embodiment of the toothbrush of the invention;

FIG. 3A is an end view of a first modification of the embodiment of FIG. 3;

FIG. 3B is an end view of a second modification of the embodiment of FIG. 3;

FIG. 4 is a side view, on a reduced scale, of a third embodiment of the toothbrush of the invention;

FIG. 4A is an end view of a first modification of the embodiment of FIG. 4;

FIG. 4B is an end view of a second modification of the embodiment of FIG. 4;

FIG. 5 is a side view, on a reduced scale, of the embodiment of FIG. 1, made in a manner different from the embodiment of FIG. 2;

FIG. 5A is an end view of a first modification of the embodiment of FIG. 5;

FIG. 5B is an end view of a second modification of the embodiment of FIG. 5;

FIG. 6 is a side view, on a reduced scale, of a fourth embodiment of the toothbrush of the invention;

FIG. 6A is an end view of a first modification of the fourth embodiment of FIG. 6;

FIG. 6B is an end view of a second modification of the fourth embodiment of FIG. 6;

FIG. 7 is a side view, on a reduced scale, of the fifth embodiment of the toothbrush of the invention;

FIG. 7A is an end view of a first modification of the fifth embodiment of FIG. 7;

FIG. 7B is an end view of a second modification of the fifth embodiment of FIG. 7;

DETAILED DESCRIPTION OF PREFERRED EMBODIMENTS

The toothbrush of the invention efficiently cleans the teeth, the area under the sulcus and between the teeth and massages and stimulates the gums thereby providing excellent oral hygiene. As shown in FIGS. 1 to 9, the toothbrush of the invention has a substantially longitudinally aligned handle 10 and a brushhead at one end of said handle. The toothbrush comprises a plurality of spaced substantially longitudinally extending rows of bristles in substantially center and outer rows extending from the brushhead. The bristles 21 and 21' of the center rows (FIGS. 1 to 9) extend substantially perpendicularly to the brushhead and the bristles of each of the outer rows are inclined in different directions relative to the bristles of the center rows.

Figure 1:
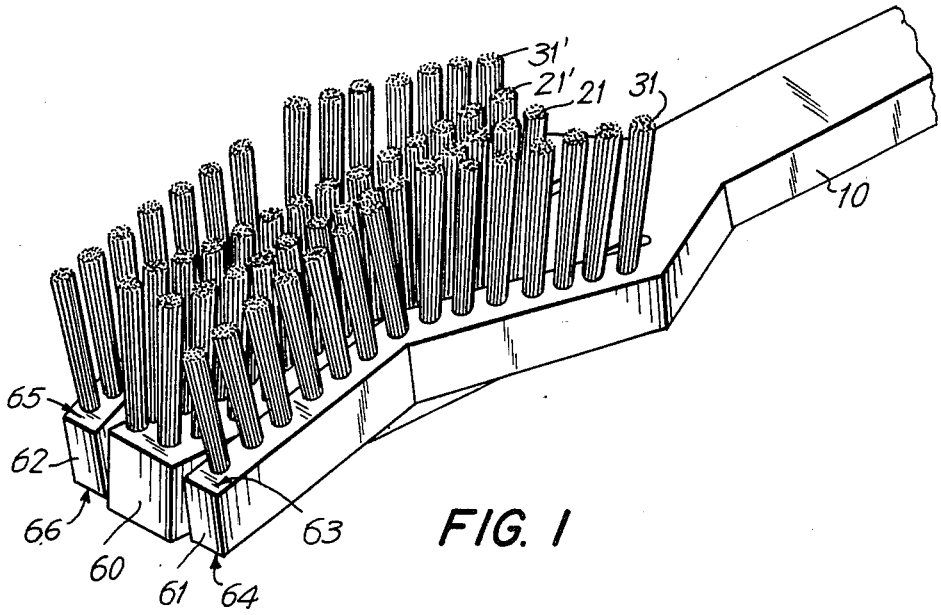
FIG. 1 is a perspective view of a first embodiment of the toothbrush of the invention.
Figures 2A, 2B:
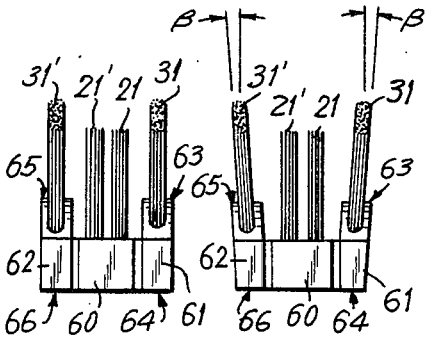
FIG. 2A is an end view of a first modification of the embodiment of FIG. 2.
FIG. 2B is an end view of a second modification of the embodiment of FIG. 2.
Figure 2:
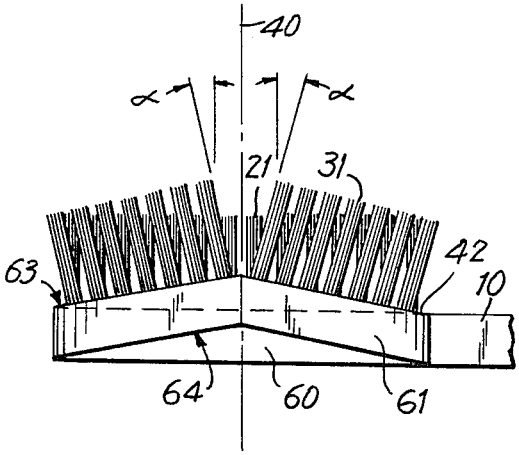
FIG. 2 is a side view, on a reduced scale, of the embodiment of FIG. 1.

The bristles 31 and 31' (FIGS. 1 and 2), 31A and 31A' (FIG. 5), 32 and 32' (FIG. 3), 33 and 33' (FIG. 4), 34 and 34' (FIG. 6) and 35 and 35' (FIG. 7) of each of the outer rows are inclined in one direction from approximately the center normal line 40 of the row (FIG. 2) to one end 41 thereof (FIG. 2) and in the opposite direction from approximately said center of said row to the opposite end 42 thereof (FIG. 2). Each of these directions is away from the normal line 40, as shown in FIGS. 1 to 7.

The angle of inclination $\alpha$ in the one direction (FIGS. 2, 5, 6 and 7) is preferably substantially 10° to 20° from the normal line 40 in the one direction and the angle of inclination $\alpha$ in the opposite direction (FIGS. 2, 5, 6 and 7) is preferably substantially 10° to 20° from said normal line in the opposite direction. In an operable embodiment of the toothbrush, the angle $\alpha$ may be greater than 20° or smaller than 10°.

In a first modification of each of the first, second, third, fourth and fifth embodiments of the invention (FIGS. 2A, 3A, 4A, 6A and 7A), the center rows of bristles 21 and 21' are in planes substantially perpendicular to the brushhead and the outer rows of bristles 31 and 31', etc. are in the planes inclined in opposite directions from the planes of said center rows preferably at angles $\beta$ of approximately 5° to 10° with the planes of said center rows. In an operable embodiment of the toothbrush, and angle $\beta$ may be greater than 10° or smaller than 5°.

In a second modification of each of the first, second, third, fourth and fifth embodiments of the inventions (FIGS. 2A, 3A, 4A, 6A and 7A), the center rows of bristles 21 and 21' and the outer rows of bristles 31 and 31', etc. are in substantially parallel planes, substantially perpendicular to the brushhead.

In the first, second, third and fifth embodiments of the invention, the great majority of the bristles 31 and 31', 31A and 31A', 32 and 32', 33 and 33' and 35 and 35' extend a greater distance from the brushhead than the bristles 21 and 21' of the center rows, as shown in FIGS. 2, 2A, 2B, 3, 3A, 3B, 4, 4A, 4B, 5, 5A, 5B and 7, 7A and 7B. In the fourth embodiment of the invention (FIGS. 6, 6A and 6B), the bristles 34 and 34' of the outer rows extend the same distance from the brushhead as the bristles 21 and 21' of the center rows.

Figure 8:
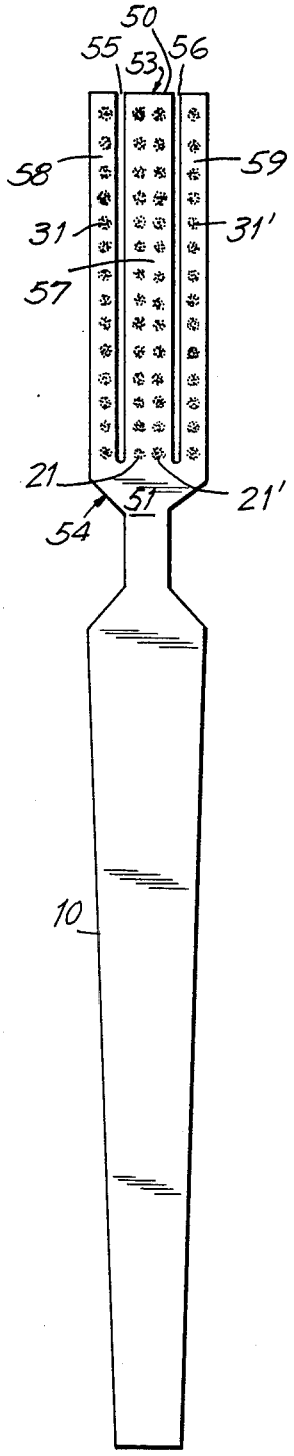
FIG. 8 is a top view of a third modification of the first, second and third embodiments of the toothbrush of the invention.
Figure 9:
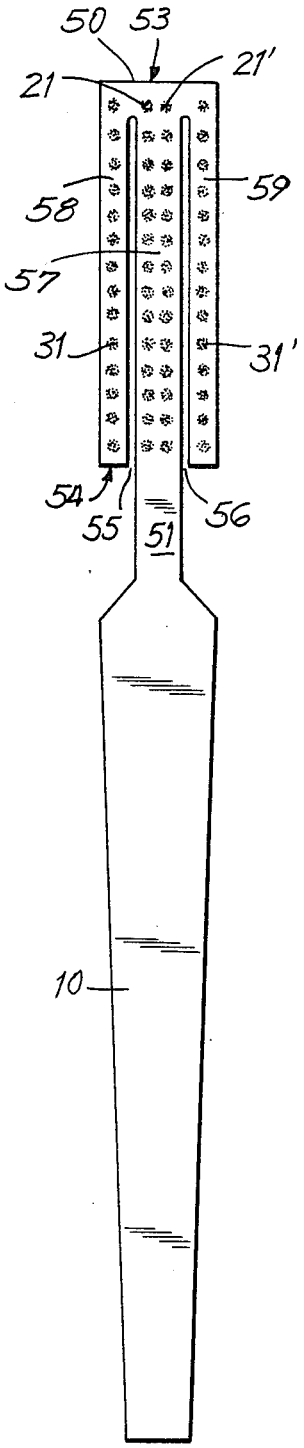
FIG. 9 is a top view of a fourth modification of the first, second and third embodiments of the toothbrush of the invention.

The brushhead 50, shown in FIGS. 8 and 9, has spaced opposite top and bottom surfaces 51 and 52 (not shown in the FIGS.) and a pair of spaced opposite end edges 53 and 54. In a third modification of the invention, shown in FIGS. 8 and 9, a pair of spaced substantially parallel slits 55 and 56 are formed through the brushhead 50 from the top to bottom surfaces and spaced from one of the end edges. Thus, in FIG. 8, the slits 55 and 56 extend from the edge 53 and are spaced from the edge 54, whereas in FIG. 9, the slits 55 and 56 extend from the edge 54 and are spaced from the edge 53. The slits 55 and 56 form a center area 57 between them for the center rows of bristles and outer areas 58 and 59 on the opposite sides of the slits from the center area for the outer rows of bristles.

In the first embodiment of the invention, as shown in FIGS. 1, 2, 2A and 2B, the center area 60 is substantially planar and each of the outer areas 61 and 62 is bent so that the top and bottom surfaces 63 and 64 and 65 and 66, respectively, are of substantially flat inverted V configuration relative to the brushhead. The bristles 31 and 31' of each of the outer rows are of substantially equal length and extend from the top surfaces 63 and 65 of the outer areas 61 and 62, respectively.

In the second embodiment of the invention, as shown in FIGS. 3, 3A and 3B, the center area 70 is substantially planar and each of the outer areas 71 and 72 is bent so that the top and bottom surfaces 73 and 74 and 75 and 76, respectively, are of substantially arcuate configuration relative to the brushhead. The bristles 32 and 32' of each of the outer rows are of substantially equal length and extend from the top surfaces 73 and 75 of the outer areas 71 and 72, respectively.

In the third embodiment of the invention, as shown in FIGS. 4, 4A and 4B, the center area 80 is substantially planar and each of the outer areas 81 and 82 is bent so that the top and bottom surfaces 83 and 84 and 85 and 86, respectively, are of the same irregular geometric configuration relative to the brushhead. The bristles 33 and 33' of each of the outer rows are of substantially equal length and extend from the top surfaces 83 and 85 of the outer areas 81 and 82, respectively.

In the modification of the first embodiment of the invention, as shown in FIGS. 5, 5A and 5B, the brushhead 90 is molded as a unitary component by any suitable known means with a pair of side border protrusions of substantially flat inverted V configuration relative to the center area 91, forming the outer areas 92 and 93. The bristles 31A and 31A' of each of the outer rows are of substantially equal length and extend from the top surfaces 94 and 95 of the outer areas 92 and 93, respectively, whereby the first and fourth embodiments are essentially the same, except for the method of making of the brushhead.

In the fourth embodiment of the invention, as shown in FIGS. 6, 6A and 6B, the brushhead 100 is a unitary component of substantially rectilinear parallelepiped configuration. Although the bristles 34 and 34' of the outer rows extend from the top substantially planar surface 101 of the brushhead 100, they are inclined, in each of said rows, respectively, in one direction from approximately the center normal line 102 of the row to one end 103 thereof and in the opposite direction from approximately said center of said row to the opposite end 104 thereof (FIG. 6). Each of these directions is away from the normal line 102, as shown in FIG. 6. The free ends of all the bristles 21, 21', 34 and 34', however, end in a plane substantially parallel to the top surface 101 of the brushhead 100.

In the sixth embodiment of the invention, as shown in FIGS. 7, 7A and 7B, the brushhead 110 is molded as a unitary component by any suitable known means with a pair of side border protrusions of substantially rectilinear parallelepiped configuration relative to the center area 111, forming the outer areas 112 and 113. The bristles 35 and 35' of each of the outer rows extend from the top surfaces 114 and 115 of the outer areas 112 and 113, respectively, and are inclined, in each of said rows respectively, in one direction from approximately the center normal line 116 (FIG. 7) to one end 117 thereof and in the opposite direction from approximately said center of said row to the opposite end 118 thereof (FIG. 7). Each of these directions is away from the normal line 116, as shown in FIG. 7. The free ends of the bristles 21 and 21' end in a first plane substantially parallel to the top surfaces 114 and 115 and the free ends of the bristles 35 and 35' end in a second plane substantially parallel to said top surfaces and spaced from the first plane.

Although the illustrated embodiments of the invention show four rows of bristles, with the inclined bristles being in the outer rows, the toothbrush of the invention may have three rows of bristles or more than four rows of bristles with more than one outer row of inclined bristles on each side.

The tootbrush of the first embodiment may be made by any suitable known manner and may be trimmed flat so that all the bristles extend the same length above the brushhead. The embodiment of FIGS. 1 and 2 may also be made with outer row bristles somewhat longer or shorter than those in the center rows. In this case, the bristles would be trimmed in the trimming operation of the conventional toothbrush manufacturing operations to achieve the longer or shorter configuration. The $\alpha$ and $\beta$ inclinations would then be provided by post forming to provide the desired configuration.

In the second, third, fourth and fifth embodiments of the invention, the angle $\beta$ is preferably 5°.

The second and third embodiments of the invention may be made by molding, in the same manner as the first embodiment as it is shown in FIG. 5, without slits and postforming and with unitary brushhead.

The fourth embodiment of the invention is not postformed, but is preferably made by utilizing modified brushmaking machines which insert the bristles at the angles shown. The fifth embodiment of the invention is preferably made by molding the brushhead in the configuration shown. Modified brushmaking machines may be utilized to insert the bristles at the angles shown and to trim the bristle ends to achieve the stepped configuration shown. The embodiment could be made by utilizing longer outer bristles and a non-stepped brushhead.

The amount of brushhead material at the closed end of the slits (FIGS. 8 and 9) affects the flexibility of the outer brushhead segments and the cleaning action of the attached bristles, and must be considered in the development of an optimum design for the toothbrush. Although two slits 55 and 56 are shown in the figures, more than two may be provided.

Although shown and described in what is believed to be the most practical and preferred embodiment, it is apparent that departures from the specific method and design described and shown will suggest themselves to those skilled in the art and may be made without departing from the spirit and scope of the invention. I, therefore, do not wish to restrict myself to the particular construction described and illustrated, but desire to avail myself of all modifications that may fall within the scope of the appended claims.

What is claimed is:

1. A toothbrush for efficient cleaning of the teeth, the area under the sulcus and between the teeth and for massage and stimulation of the gums, said toothbrush having a substantially longitudinally aligned handle and brushhead at one end of said handle, said toothbrush comprising a plurality of spaced substantially longitudinally extending rows of bristles in substantially center and outer rows extending from said brushhead, the bristles of said center rows extending substantially perpendicularly to said brushhead and the bristles of each of said outer rows being inclined in different directions relative to the bristles of said center rows, said bristles of each of said outer rows being inclined in one direction from approximately the center of the row to one end thereof and in the opposite direction from approximately said center of said row to the opposite end thereof, each of said one and opposite directions being away from a normal line at approximately said center of said row.

2. A toothbrush as claimed in claim 1, wherein said rows of bristles are in substantially parallel planes.

3. A toothbrush as claimed in claim 1, wherein said center rows of bristles are in planes substantially perpendicular to said brushhead and said outer rows of bristles are in planes inclined in opposite directions from the planes of said center rows.

4. A toothbrush as claimed in claim 1, wherein the great majority of the bristles of said outer rows extend a greater distance from said brushhead than the bristles of said center rows.

5. A toothbrush as claimed in claim 1, wherein the bristles of said outer rows extend the same distance from said brushhead as the bristles of said center rows.

6. A toothbrush as claimed in claim 1, wherein said brushhead has spaced opposite top and bottom surfaces, a pair of spaced opposite end edges and a pair of spaced substantially parallel slits through said brushhead from said top to bottom surfaces and spaced from one of said end edges, said slits form a center area between them for said center rows of bristles and outer areas on the opposite sides of said slits from said center area for said outer rows of bristles.

7. A toothbrush as claimed in claim 1, wherein the angle of inclination in said one direction is substantially 10° to 20° from said normal line in said one direction and the angle of inclination in said opposite direction is substantially 10° to 20° from said normal line in said opposite direction.

8. A toothbrush as claimed in claim 3, wherein said planes of said outer rows are inclined at angles of approximately 5° to 10° with said planes of said center rows.

9. A toothbrush for efficient cleaning of the teeth, the area under the sulcus and between the teeth and for massage and stimulation of the gums, said toothbrush having a substantially longitudinally aligned handle and brushhead at one end of said handle, said toothbrush comprising a plurality of spaced substantially longitudinally extending rows of bristles in substantially center and outer rows extending from said brushhead, the bristles of said center rows extending substantially perpendicularly to said brushhead and the bristles of each of said outer rows being inclined in different directions relative to the bristles of said center rows, the great majority of the bristles of said outer rows extending a greater distance from said brushhead than the bristles of said center rows, the free ends of the bristles of each of said outer rows forming a substantially flat inverted V configuration relative to said brushhead.

10. A toothbrush for efficient cleaning of the teeth, the area under the sulcus and between the teeth and for massage and stimulation of the gums, said toothbrush having a substantially longitudinally aligned handle and brushhead at one end of said handle, said toothbrush comprising a plurality of spaced substantially longitudinally extending rows of bristles in substantially center and outer rows extending from said brushhead, the bristles of said center rows extending substantially perpendicularly to said brushhead and the bristles of each of said outer rows being inclined in different directions relative to the bristles of said center rows, the great majority of the bristles of said outer rows extending a greater distance from said brushhead than the bristles of said center rows, the free ends of the bristles of each of said outer rows forming a substantially arcuate configuration relative to said brushhead.

11. A toothbrush for efficient cleaning of the teeth, the area under the sulcus and between the teeth and for massage and stimulation of the gums, said toothbrush having a substantially longitudinally aligned handle and brushhead at one end of said handle, said toothbrush comprising a plurality of spaced substantially longitudinally extending rows of bristles in substantially center and outer rows extending from said brushhead, the bristles of said center rows extending substantially perpendicularly to said brushhead and the bristles of each of said outer rows being inclined in different directions relative to the bristles of said center rows, the great majority of the bristles of said outer rows extending a greater distance from said brushhead than the bristles of said center rows, the free ends of the bristles of each of said outer rows forming an irregular geometric configuration relative to said brushhead.

12. A toothbrush as claimed in claim 4, wherein the free ends of the bristles of each of said outer rows form a substantially linear configuration relative to said brushhead and parallel to said brushhead.

13. A toothbrush as claimed in claim 4, wherein the maximum length of the bristles of said outer rows from said brushhead is approximately 33% greater than the length of the bristles of said center rows from said brushhead.

14. A toothbrush for efficient cleaning of the teeth, the area under the sulcus and between the teeth and for massage and stimulation of the gums, said toothbrush having a substantially longitudinally aligned handle and brushhead at one end of said handle, said toothbrush comprising a plurality of spaced substantially longitudinally extending rows of bristles in substantially center and outer rows extending from said brushhead, the bristles of said center rows extending substantially perpendicularly to said brushhead and the bristles of each of said outer rows being inclined in different directions relative to the bristles of said center rows, said brushhead having spaced opposite top and bottom surfaces, a pair of spaced opposite end edges and a pair of spaced substantially parallel slits through said brushhead from said top to bottom surfaces and spaced from one of said end edges, said slits forming a center area between them for said center rows of bristles and outer areas on the opposite sides of said slits from said center area for said outer rows of bristles, said center area being substantially planar and each of said outer areas being of substantially flat inverted V configuration, the bristles of each of said outer rows being of substantially equal length and extending from the top surfaces of said outer areas.

15. A toothbrush for efficient cleaning of the teeth, the area under the sulcus and between the teeth and for massage and stimulation of the gums, said toothbrush having a substantially longitudinally aligned handle and brushhead at one end of said handle, said toothbrush comprising a plurality of spaced substantially longitudinally extending rows of bristles in substantially center and outer rows extending from said brushhead, the bristles of said center rows extending substantially perpendicularly to said brushhead and the bristles of each of said outer rows being inclined in different directions relative to the bristles of said center rows, said brushhead having spaced opposite top and bottom surfaces, a pair of spaced opposite end edges and a pair of spaced substantially parallel slits through said brushhead from said top to bottom surfaces and spaced from one of said end edges, said slits forming a center area between them for said center rows of bristles and outer areas on the opposite sides of said slits from said center area for said outer rows of bristles, said center area being substantially planar and each of said outer areas being of substantially arcuate configuration, the bristles of each of said outer rows being of substantially equal length and extending from the top surfaces of said outer areas.

16. A toothbrush for efficient cleaning of the teeth, the area under the sulcus and between the teeth and for massage and stimulation of the gums, said toothbrush having a substantially longitudinally aligned handle and brushhead at one end of said handle, said toothbrush comprising a plurality of spaced substantially longitudinally extending rows of bristles in substantially center and outer rows extending from said brushhead, the bristles of said center rows extending substantially perpendicularly to said brushhead and the bristles of each of said outer rows being inclined in different directions relative to the bristles of said center rows, said brushhead having spaced opposite top and bottom surfaces, a pair of spaced opposite end edges and a pair of spaced substantially parallel slits through said brushhead from said top to bottom surfaces and spaced from one of said end edges, said slits forming a center area between them for said center rows of bristles and outer areas on the opposite sides of said slits from said center area for said outer rows of bristles, said center area being substantially planar and each of said outer areas being of the same irregular geometric configuration, the bristles of each of said outer rows being of substantially equal length and extending from the top surfaces of said outer areas.

* * * * *